United States Patent [19]

Kelly

[11] Patent Number: 4,665,675

[45] Date of Patent: May 19, 1987

[54] NON-WICKING SIDING

[76] Inventor: Kevin Kelly, 2 Glen St., New Hartford, N.Y. 13413

[21] Appl. No.: 822,140

[22] Filed: Jan. 24, 1986

[51] Int. Cl.[4] ..... E04D 1/00

[52] U.S. Cl. ..... 52/534; 52/553; 52/303

[58] Field of Search ..... 52/551, 560, 95, 303, 52/553, 533, 534

[56] References Cited

U.S. PATENT DOCUMENTS

| | | | |
|---|---|---|---|
| 173,957 | 2/1876 | Inman | 52/560 |
| 2,835,932 | 5/1958 | Walton | 52/560 |
| 3,034,261 | 5/1962 | Hollmann et al. | 52/533 X |
| 3,204,379 | 9/1965 | Osborn | 52/303 |
| 4,098,044 | 7/1978 | Slavik | 52/303 |

*Primary Examiner*—Carl D. Friedman
*Assistant Examiner*—Naoko N. Slack
*Attorney, Agent, or Firm*—Bruns and Wall

[57] ABSTRACT

Clapboard siding has a channel rabbeted at the back bottom edge to prevent wicking of rainwater between clapboards, and has a plurality of vertical vent channels or grooves cut in the back surface so that air can vent into the space between the structure and the siding.

4 Claims, 3 Drawing Figures

NON-WICKING SIDING

BACKGROUND OF THE INVENTION

This invention concerns siding for a house or other frame structure, and is more particularly concerned with an improved clapboard siding which is resistant to wind and rain and which is structured to avoid moisture and heat buildup in the siding and in the space just beneath the siding.

Clapboard siding, per se, is a well known term in the building trades, as its form and the manner of applying it to houses or other structures have not changed significantly for over a century. "Bevel siding" is another commonly used term for clapboards.

The name "clapboard" is derived from the clapping noise created when a number of the boards are carried on a shoulder at one time. Clapboards were one of the first items exported to the old world by the early settlers of the New England Colonies. The original use of clapboards as siding was on "half timber" or "post and beam" type buildings which had used "wattle and daub" or brick to fill in spaces between the exposed timber framing. Through the years the art of building was changed to using studs and corner bracing and a plywood or composite board subsiding, while still covering the exterior with clapboards. The use of clapboards by the early settlers, as now, was to shed rain as well as sunlight, while beautifying. Stopping wind and insulating was a function of the wattle and daub, and these are functions of the subsiding and insulation today. Thus, clapboards function more as shedders of sun and rain, not as wind and heat barriers.

Wind blowing over a structure creates a negative pressure on the lee side, causing warm, moist air to be drawn out of the building on the lee side. However, conventional clapboards restrict this moisture from leaving the structure. Accordingly, holes are then bored through the siding to inlets and outlets for air and vapor.

Sunlight raises the exterior surface temperature of the building as high as 170° F. Clapboard and other wood sidings will hold five to ten times more water at this high temperature than they hold at normal air temperatures. When the temperature drops, the moisture condenses, often blistering the paint or finish on the siding, and often leading to rot and warping. Moisture, mold and mildew problems within many houses are often caused by wide temperature variations within the envelope of the building.

Conventional clapboard siding also tends to pick up rainwater and to "wick" the rain up into the lap between adjacent clapboards. This is especially true on the windward side of the house or other structure. This water adds to the problem of moisture mentioned previously.

OBJECTS AND SUMMARY OF THE INVENTION

Accordingly, it is an object of this invention to provide a clapboard sided structure that avoids the problems inherent with conventional clapboard siding.

It is another object of this invention to provide improved clapboard siding that functions singularly as a shedder of rain and sunlight, and which will provide unrestricted channels for moisture out from the building envelope.

It is still another object of this invention to provide clapboard siding that avoids the problem of wicking of rain or other mositure between adjacent clapboards.

It is a further object of this invention to provide clapboard siding that will maintain its pleasing external appearance without the need for continual, annual refinishing.

In keeping with the above objects, an improved clapboard siding, constructed to be weather resistant, is formed of clapboard members, each having a top horizontal edge, a bottom horizontal edge face, an outward-facing front face, and a back face. The back face is rabbeted at the bottom edge to form a horizontal anti-wicking channel, and the back face is grooved forming a plurality of vertical venting channels, each one communicating with the anti-wicking channel and extending at least part way toward the top edge, that is, to a point above the location of the top edge of the clapboard member therebelow, i.e., the clapboard member that this clapboard member laps.

The presence of the anti-wicking channel ensures that rain that falls onto the siding will drip down from clapboard to clapboard, and not seek the lapping surfaces between clapboards. The venting channels provide a means for airflow into the spacing between the siding and the subsiding beneath it. This space is vented through the soffit into the building roof, and thence to the atmosphere, so that the moisture from the interior of the house or structure does not accumulate beneath the siding.

The arrangement of this invention reduces the temperature variations between the siding and the structure interior caused both by winter and summer sunlight, thereby avoiding many or most of the problems inherent with conventional clapboard siding.

The above and many other objects, features, and advantages of this invention will become apparent from the ensuing detailed description of a preferred embodiment of the clapboard siding of this invention, which should be read in conjunction with the accompanying drawing.

DETAILED DESCRIPTION OF THE PREFERRED EMBODIMENT

Figure 1:
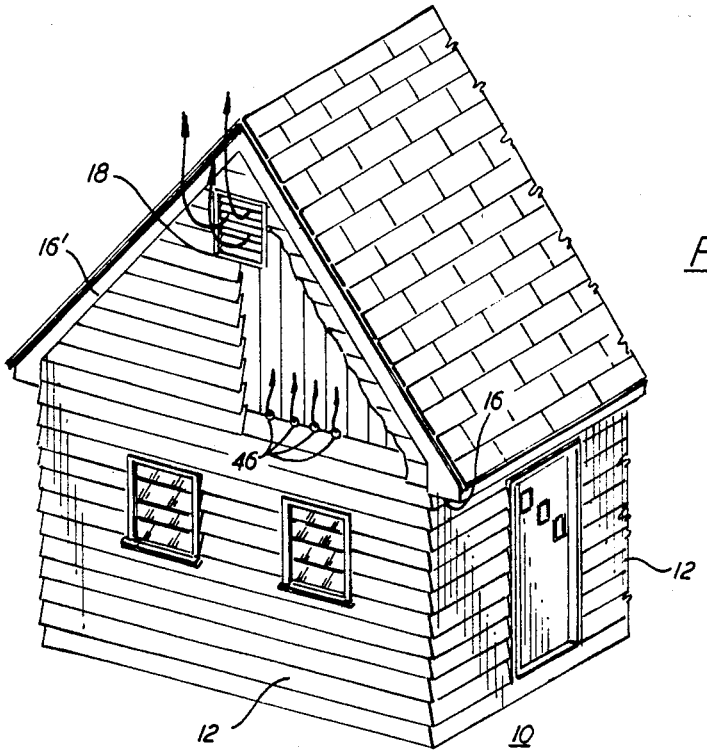
FIG. 1 is a perspective view, partly cut away, of a portion of a structure employing the clapboard siding of one embodiment of this invention.

With reference to the drawing, FIG. 1 illustrates a home 10 having wood clapboard siding 12 and a roof 14, as well as various (unnumbered) doors and windows. While the siding 12 here is wood, this invention could be practiced as well on vinyl, aluminum, steel, or other sidings, this particular siding serving as an example. A soffit 16 and attic gabled end 16' separates the walls from the upper structure (which includes the roof 14). A louvered vent 18 is situated beneath eaves near the roof 14 to vent air and moisture from under the siding 12 out to the atmosphere.

Figure 2:
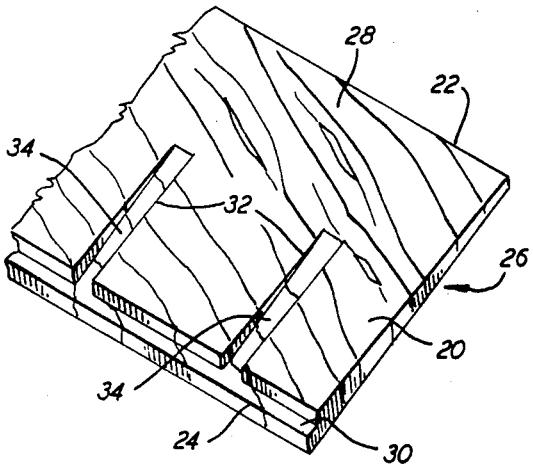
FIG. 2 is a perspective view of a clapboard siding member of this embodiment, showing its back and bottom surfaces.
Figure 3:
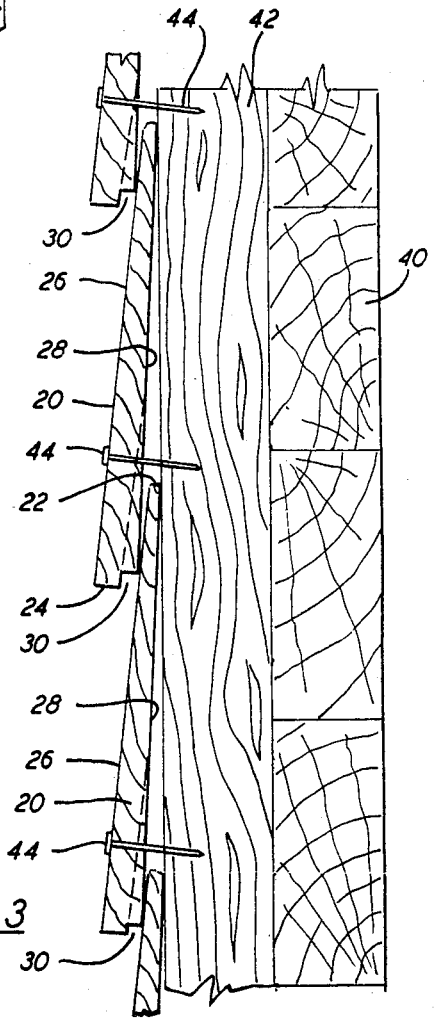
FIG. 3 is a side sectional elevation of the structure employing the clapboard siding members of this embodiment.

The siding 12 itself is made of clapboards 20 as shown generally in FIGS. 2 and 3. The clapboards 20 are elongated wood members to be disposed generally laterally or horizontally on the exterior of the home 10, and in this embodiment each clapboard is somewhat wedge shaped in cross section, with a top edge 22, a bottom surface 24, a front or exterior surface 26 (obscured in FIG. 2) which is rough surfaced, e.g. saw texture finished, so it will take a deep penetration of stain and an optional preservative, and a back surface 28.

At the corner of the back surface 28 and the bottom edge surface 24 a horizontal anti-wicking channel 30 is rabbeted, and a number of vertical vent channels 32 are cut in the back surface 28, extending from the anti-wicking channel upwards for a portion of the height of the clapboard 20. In this embodiment the bottom edge surface 24 of the clapboard 20 is about 7/16 inch to 1¼ inch in width; the front and back surfaces 26, 28 converge towards the top edge; the vertical and thickness dimensions of the anti-wicking channel 30 are about one-eighth to one-forth inch; the kerf of the vent channels 32 is about one-eighth inch, and these are spaced laterally from one another at intervals from about four inches to about ten inches. Here also, the vent channels 32 are cut to have a floor 34 that is about one-eighth inch in depth, at its lower end, and that runs parallel to the front surface 26. In place on the home 10, the lower edge of the clapboard 20 laps the clapboard beneath it so that it covers the top edge 22 and an upper portion of the front surface 26 of the next clapboard 20 beneath. Accordingly, the vent channels 32 should extend above the line of the top edge 22 of the next-beneath clapboard 20.

The siding 12 is applied to the home 10 as follows. A subsiding 40, usually of panels of plywood, pressed wood, or composite, is fastened to the frame of the home 10, using nails, brads, staples, or other suitable fasteners. Then three-eighths inch vertical wood laths 42 are fastened onto the subsiding 40, at sixteen-inch-center spacing, or any other uniform spacing strong enough to support the clapboard siding 12. The siding clapboards 20 are fastened onto the laths 42 using double-dip galvanized storm-guard nails 44. Preferably, the heads of the nails 44 are painted prior to application. The vertical laths 42, siding 12, and subsiding 40 define vertical vent spaces that run the length of the exterior walls of the home 10. The bottoms of these spaces can be closed off with horizontal lengths of the lath. Vents 46 are bored or cut into the soffit 16, or are bored or cut into the gabled end of the attic 16' to create a free-flow air passage to the louvered vent 18 and thence to the atmosphere. Horizontal vents (not illustrated) can also be supplied in the vertical lath 42 around the windows and doors to ensure a continuous unobstructed air flow around those obstacles.

If there are cracks or leaks in the subsiding 40, these can be sealed with Tyvek or another air barrier material to stop air penetration through the subsiding.

The clapboards 20 can be finished with a stain only, or with a stain and a preservative. In the latter case, it should be understood that some preservatives do not hold stains well, so the preservative should be selected with this fact in mind and then used sparingly. If paint or stain is used, a latex or alkyd product may fade less quickly than oil base products. The horizontal cracks between the clapboards 20 should not be painted, caulked, or otherwise sealed, as the siding 12 is not intended to be water tight or wind tight, but is intended only to shed the weather.

The anti-wicking channels 30, which run the horizontal length of each clapboard 20, form anti-wicking vertical recesses at the horizontal joints of adjacent clapboards 20. These prevent wind-driven rainwater from travelling to the joints between the clapboards 20, so that the wicking of rainwater between clapboards 20 is reduced or eliminated. This wicking of rainwater in conventional clapboard siding increases the hazard of rotting of the wood and peeling of paint on the clapboard.

The back-vented arrangement of the vertical vent channels 34 allows air and vapor movement in the cavity between the siding 12 and the subsiding 40 of the home 10 or other building. This allows equalization of thermal and vapor pressures of the air on both the front and back sides 26, 28 of the siding 12. Grooving with the channels 34 as shown and described produces ventilation channels that meet or exceed FHA (Federal Housing Administration) requirements, or those of other regulatory authorities, for ventilation.

The weather-shedding siding 12 of this invention produces a warm look for the home 10 or other building, and has low maintenance costs and long life at low initial and overhead costs.

As mentioned before, the clapboards can be of any material, and need not be wood, and would greatly benefit from the anti-wicking channels 30 and vertical vent channels 32. For example, siding formed of compressed wood chips can benefit directly from this invention's anti-wicking, ventilating design. Vinyl siding, aluminum siding, and steel siding each have so-called weep holes which allow condensed moisture to drain out, but this feature would be greatly improved upon by adding vertical ventilation paths to each of these types of siding.

While a specific embodiment has been described in detail hereinabove, it should be understood that the invention is certainly not limited to that embodiment, and that many modifications and variations would present themselves to those skilled in the art without departure from the scope and spirit of this invention, as defined in the appended claims.

I claim:

1. An improved weather resisting siding for a structure that includes an elongated clapboard siding member formed of a single piece of wood that has a top horizontal edge, a bottom horizontal edge face, an outwardly facing front face and an opposed back face whereby the member can be placed in overlapping relationship with upper and lower members of similar construction to provide a uniform vertically disposed contact zone between overlapping members, the back face of the member having a plurality of spaced vertical channels formed therein that extend from an entrance at the bottom edge face a distance that is greater than the width of the contact zone to permit air to be exchanged between the space behind the member and the surrounding ambient, said back face being rabbeted at the bottom corner thereof to form a narrow horizontally disposed channel that passes through the entrance to each vertical channel, the depth of each vertical channel at the entrance being substantially equal to the depth of the horizontal channel passing therethrough to provide a continuous horizontally disposed drip edge along the bottom face of the member to prevent moisture moving down the front face of the member from passing behind the member while at the same time exposing the entrance to each vertical channel to the surrounding ambient whereby air is efficiently exchanged between said space behind the member and the ambient.

2. The improved siding of claim 1 wherein the horizontal channel has a depth and width dimension of about one-eighth to one-forth inch.

3. The improved siding of claim 1 wherein the spacing between vertical channels is about four to ten inches.

4. The improved siding of claim 1 wherein the back face of the member tapers towards the top edge.

* * * * *